US008534526B2

(12) United States Patent
Orchard

(10) Patent No.: US 8,534,526 B2
(45) Date of Patent: Sep. 17, 2013

(54) CLIP GUIDE INSTALLATION APPARATUS

(76) Inventor: Brian Keith Orchard, London (CA)

( * ) Notice: Subject to any disclaimer, the term of this patent is extended or adjusted under 35 U.S.C. 154(b) by 32 days.

(21) Appl. No.: 13/009,246

(22) Filed: Jan. 19, 2011

(65) Prior Publication Data

US 2011/0173921 A1 Jul. 21, 2011

Related U.S. Application Data

(60) Provisional application No. 61/296,350, filed on Jan. 19, 2010.

(51) Int. Cl.
*B25C 3/00* (2006.01)

(52) U.S. Cl.
USPC ..... 227/107; 52/DIG. 1; 81/180.1; 81/44; 227/120

(58) Field of Classification Search
USPC ..... 52/DIG. 1; 33/526, 527; 269/3, 269/6, 95; 81/44, 180.1, 185.2; 227/120, 227/119, 107
See application file for complete search history.

(56) References Cited

U.S. PATENT DOCUMENTS

| | | | | | |
|---|---|---|---|---|---|
| 2,886,815 | A * | 5/1959 | Young | 227/120 |
| 4,424,929 | A * | 1/1984 | Weis | 227/32 |
| 4,485,952 | A * | 12/1984 | Weis | 227/7 |
| 5,136,768 | A * | 8/1992 | Sato | 29/243.56 |
| 5,267,391 | A * | 12/1993 | Ingraham | 29/566.1 |
| 5,634,583 | A * | 6/1997 | McGuinness et al. | 227/120 |
| 6,302,310 | B1 * | 10/2001 | Lamb | 227/119 |
| 6,318,619 | B1 * | 11/2001 | Lee | 227/134 |
| 6,481,610 | B1 * | 11/2002 | Liu et al. | 227/18 |
| 6,481,613 | B1 * | 11/2002 | Tebo | 227/147 |
| 6,711,809 | B1 * | 3/2004 | Fischer et al. | 29/813 |
| 6,932,260 | B1 * | 8/2005 | Chou | 227/18 |
| 7,090,109 | B2 * | 8/2006 | Burlingame et al. | 227/18 |
| 7,712,646 | B2 * | 5/2010 | Gamble et al. | 227/29 |
| 8,011,153 | B2 * | 9/2011 | Orchard | 52/489.1 |
| 2008/0066417 | A1 * | 3/2008 | Orchard | 52/650.3 |
| 2009/0095786 | A1 * | 4/2009 | Gosis et al. | 227/119 |
| 2010/0181362 | A1 * | 7/2010 | Martel et al. | 227/120 |
| 2010/0213237 | A1 * | 8/2010 | Tebo | 227/148 |

OTHER PUBLICATIONS

Shadoe Track, Ultimate deck fastening system, Mar. 4, 2009, http://web.archive.org/web/20090304001435/http://www.shadoetrack.com/products/mantis. . . .*

Operation Manual "The Elminator" NSDPP38/40 Positive Placement Ballistic Nailscrew Driver, Feb. 1, 2010, p. 1-10.*

* cited by examiner

*Primary Examiner* — Joshua J Michener
*Assistant Examiner* — Elizabeth A Plummer

(57) ABSTRACT

A clip guide apparatus for installation of decking members to an underlying joist structure by means of a clip with a pneumatic screw gun. The clip guide apparatus is comprised of a guide apparatus and a clip installation guide which are attached to the screw gun. The clip installation guide slides in the guide apparatus in response to the operative movement of the screw gun to advance the clip into a decking member. The clip is secured in position with a screw fastener whereby the decking member is secured to the underlying joist structure.

5 Claims, 8 Drawing Sheets

CLIP GUIDE INSTALLATION APPARATUS

CROSS-REFERENCE TO RELATED APPLICATIONS

The present invention claims benefit of priority to U.S. patent application Ser. No. 61/,296,350, which was filed on 19 Jan. 2010, and which is incorporated by reference as if fully recited herein.

BACKGROUND OF THE INVENTION

The invention relates to a clip guide apparatus intended to facilitate the installation of outdoor decking by invisible or hidden attachment means. According to this method of attachment, decking members are secured to the underlying joist structure without the insertion of securement nails or screws into the visible top surface of the decking member. The decking members are installed and held in place by means of clips attached to an underlying joist structure as described, for example, in my co-pending U.S. patent application Ser. No. 12/379,126.

The use of this type of attachment requires that the clip be fixedly secured to the underlying joist structure and decking member. In the example clip used to describe an embodiment of the invention, the decking members are adapted with a longitudinal groove in each side edge along the entire length of the decking member. The clips have opposed flanges which are retained within the grooves of adjacent decking members thereby securing the decking members to the joist by means of the clip. According to this system and method of installation, there is no penetration of any surface of the decking member by any fastening means which is particularly advantageous with the emerging use and availability of non-wood, PVC or composite decking materials which are more expensive than treated lumber or cedar.

Ordinarily, the clip is secured to the underlying joist structure by means of a screw fastener typically installed by a hand held power driver. The use of a pneumatic screw gun makes the installation more efficient with the use of a magazine for storing a plurality of screw fasteners thus eliminating the need for individual handling of each screw fastener.

SUMMARY OF THE INVENTION

To further increase installation efficiency, a clip guide apparatus is proposed for use with a pneumatic screw gun. In operation, the clip guide apparatus operatively abuts against the grooved edge of the decking member and a clip is manually placed within the guide apparatus. Forward manual movement of the pneumatic screw gun within the guide apparatus advances the clip into position within the groove of the decking member and against the top surface of the joist. Thereafter, activation of the pneumatic screw gun easily and efficiently attaches the clip to the joist by means of a screw fastening member thereby securing the decking member to the underlying joist.

It is an object of the present invention to provide a clip guide apparatus for installation of decking members to an underlying joist structure by means of a clip with a pneumatic fastening tool. Typically, the tool has a head and a magazine. The clip installation guide comprises a guide apparatus and a clip installation guide which are attached to the tool.

The guide apparatus comprises a base plate with a length and width and opposing upwardly extending side members along each side of the base plate forming a channel. One side member has a longitudinal slot parallel to said base. The length of the base plate is shortened with reference to the length of the side members to form a U-shaped open area at one end of the channel and the guide apparatus is slideably connected to the tool magazine by fastening means passing through the slot.

The clip installation guide comprises a body having a base, width and leading edge for engaging the clip. The body is attached to the head of the pneumatic tool. The width of the body is smaller than the width of the channel to permit relative sliding motion of the clip installation guide in the channel. Spring means are operatively connected between the guide apparatus and the clip installation guide to control relative longitudinal motion therebetween. Preferably the pneumatic fastening tool is a pneumatic screw gun.

It is another object of the present invention to adapt the clip guide apparatus for use with a specialized clip having a base portion with first and second opposed ends and a thickness. There is a first vertical leg portion integral with the base portion and the second vertical leg portion integral with the base portion horizontally spaced apart from the first vertical leg portion on the base between said first and second opposed ends. The arm flange portions are integral with the first and second vertical leg portions and are spaced from the base and aligned respectively towards said first and second opposed ends. A fastener receiving means is located in the base portion. The portions define diametrically opposed first and second U-shaped jaw elements for holding a structural member.

Another object is to use a decking member having a rectangular cross section and a longitudinal groove in each side edge defining a top and bottom edge portion.

DESCRIPTION OF THE DRAWINGS

In order that the invention may be more clearly understood, a preferred embodiment thereof will now be described in detail by way of example, with reference to the accompanying drawings, in which.

DESCRIPTION OF PREFERRED EMBODIMENTS

A preferred embodiment of the clip guide apparatus will now be described with reference to the drawings and an example clip.

Figure 1:
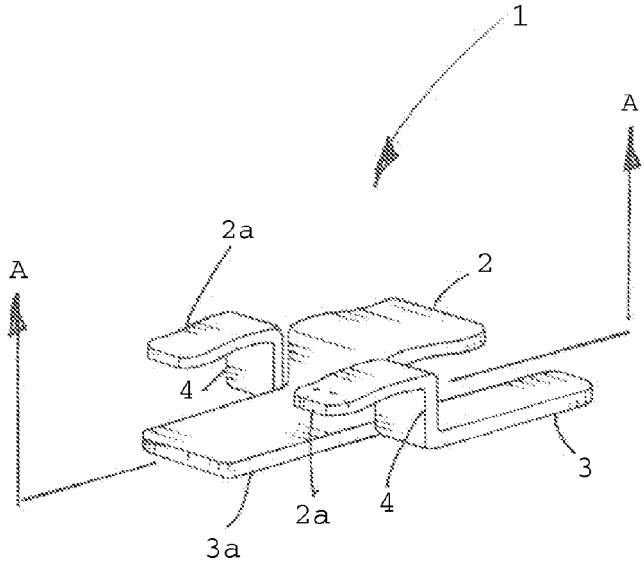
FIG. 1 is a perspective view of the example clip used to illustrate an embodiment of the invention
Figure 2:
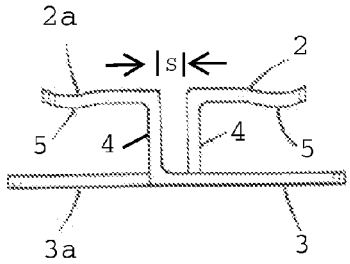
FIG. 2 is a cross sectional view of the example clip taken along A-A of FIG. 1
Figure 3:
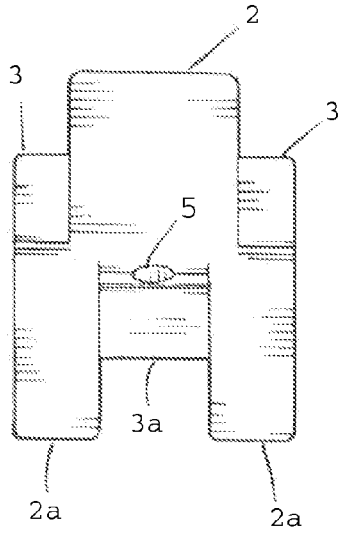
FIG. 3 is a top view of the FIG. 1 clip
Figure 4:
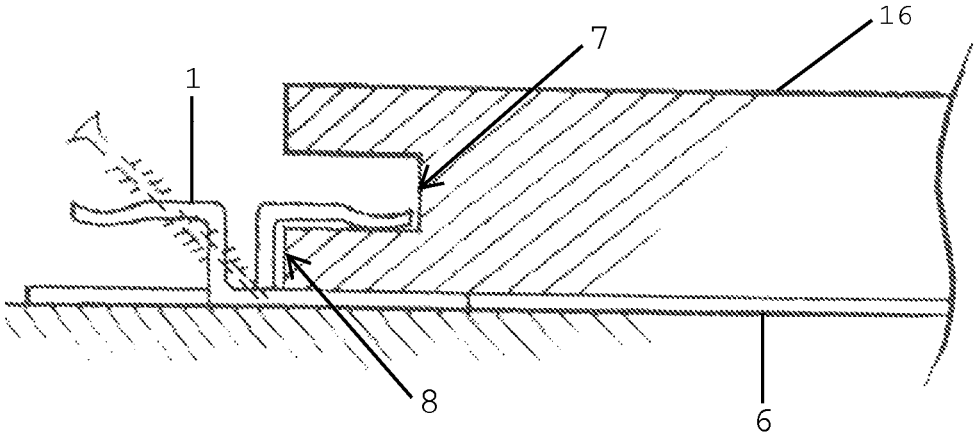
FIG. 4 is a cross sectional view of a deck member and clip at one stage of assembly

Referring to FIGS. 1-4 a unitary clip 1 is used by way of example to illustrate an embodiment of this invention. The clip is intended to be used in conjunction with a deck member or plank which is manufactured with a longitudinal groove or slot 7 in each opposing end as shown in FIG. 4. In use, the clip is securely fastened to the surface of a supporting deck surface such as a joist member 6 and serves as an anchoring device to secure the decking members to a joist structure. This method of installing decking members is especially useful for more expensive decking members manufactured from non-wood, PVC or composite materials. Traditional wood decking members may also be used.

The example clip 1 has diametrically opposed arm flanges 2 and 2*a* which are respectively connected to a pair of diametrically opposed base portions 3 and 3*a* by means of vertical legs 4 thereby forming diametrically opposed U-shaped jaws on either side of the clip to engage the bottom grooved edge 8 of the deck member as will be hereinafter described. The base portions 3 and 3*a* have a uniform thickness which functions to elevate the deck board above the supporting joist to provide for air circulation. The vertical legs 4 for each opposing arm flange are horizontally spaced from one another a distance S as shown in FIG. 4 to provide for uniform spacing between the deck members when installed.

Figure 5:
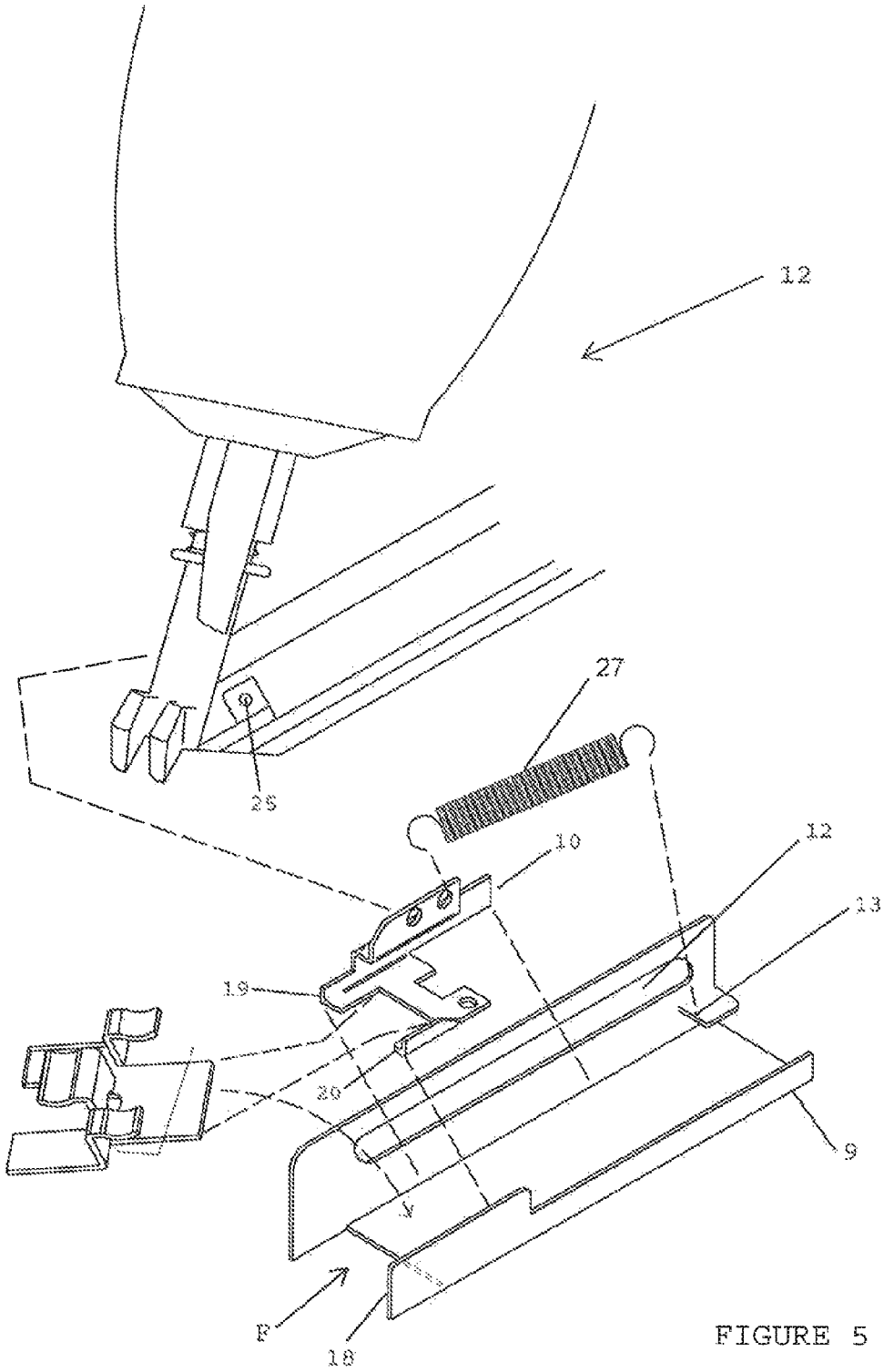
FIG. 5 is an exploded view of the various elements of the clip guide apparatus according to this invention

Referring to FIG. 5, the various elements of the clip guide mechanism are shown spatially shown and referenced to each other, the pneumatic screw gun and the clip. In operation, the clip 1 is manually placed into the clip guide apparatus. The clip 1 is advanced in the guide apparatus 9 by means of the clip installation guide 10. The clip installation guide is properly aligned and securely attached to the head of a pneumatic screw gun 12 by any suitable means using either pre-existing fastening locations on the head of the tool or adapting the head to permit attachment to the clip installation guide by means of fasteners passing through fastening holes 21 shown in FIG. 7.

The clip installation guide 10 is dimensioned to slideably fit within the guide apparatus 9 and slide therein in response to the manual motion of the pneumatic screw gun 12 by the operator. The clip is thereby urged into the installation position wherein the clip is secured to the underlying joist structure when the screw gun is operated.

Figure 10:
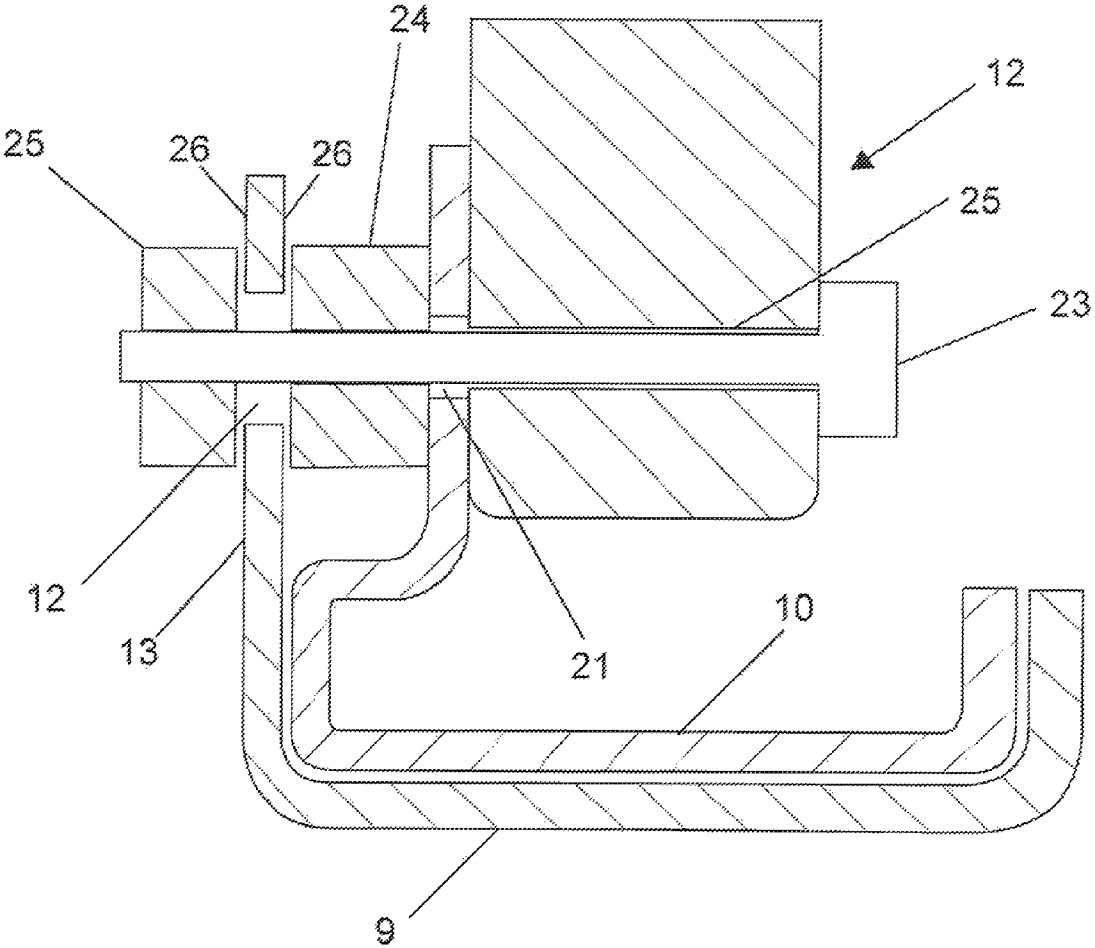
FIG. 10 is a schematic illustration of a bolt fastener at cross section 8*a* in FIG. 9.

The guide apparatus 9 is slideably mounted on the magazine side of the pneumatic screw gun by means of suitable bolt means passing through the slot 12 to engage pre-existing bolt receiving means 25 on the magazine. Typically there are pre-existing bolts on the magazine side of the tool which may be used to attach the clip guide. In other cases the tool magazine may have to be adapted with suitable fastening means. The slideable attachment permits aligned longitudinal movement of the pneumatic screw gun with reference to the guide apparatus. Referring to FIG. 10, an example of a fixed and slideable attachment of the clip guide apparatus to the screw gun is schematically shown. A bolt 23 passes through the aperture 25 in the head or magazine of the screw and engages the clip guide and the clip guide assembly on the other side. The clip guide is fixedly attached to the screw gun by means of nut 24. The clip guide assembly is slideably attached by means of lock nut 25 leaving space 26 on either side of the side rail member 13 to permit slideable relative movement between the clip guide assembly and the screw gun.

The forward movement of the pneumatic screw gun 12 elongates a spring 27 attached via holes 13 located at the rear of the guide apparatus 9 and the clip installation guide 10. The spring operates to rearwardly retract the pneumatic screw gun within the guide after installation of a clip. Retraction exposes the forward end of the guide apparatus 9 to permit the placement of the next clip into the guide apparatus and so forth as required or desired by the installer.

Figure 6:
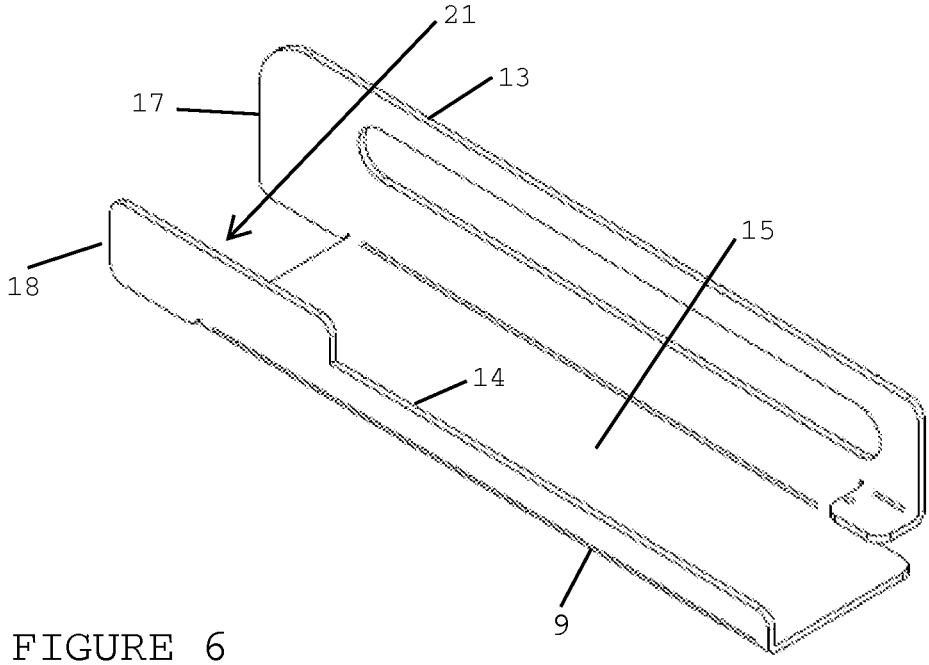
FIG. 6 is a perspective view of an embodiment of the guide apparatus according to this invention

Referring to FIG. 6, the guide apparatus 9 has side rail members 13 and 14 extending upwardly from a base plate 15 which together form a channel or guide to slideably receive the clip installation guide 10 therein. At the front of the guide apparatus there is a U-shaped open area 21 formed by shortening the base plate 15 in relation to the forward edges 17 and 18 of the side rail members. The U-shaped area 21 is sized to receive the clip installation guide together with the clip.

In operation, the guide apparatus is placed over an underlying joist and urged forwardly into an abutting contact relationship with the grooved edge of the decking member. A clip is manually placed into the guide apparatus in aligned fashion with the arm flange 2 facing forwardly in the direction of the decking member. The clip installation guide is manually advanced in the guide apparatus to engage the spaced apart vertical legs 4 of the clip. The clip is urged forwardly within the clip installation guide and together are lowered into position in the U-shaped open area 21 of the guide apparatus. In this position the bottom of the clip is in contact with the top surface of the underlying joist. From this position the clip is finally advanced into the installation position wherein the flange 2 is fully inserted into the groove and the base 3 is underneath the decking member 16. The clip is now correctly positioned to receive a screw fastener from the pneumatic screw gun. In operation a continuous forward movement of the screw gun installs and secures the clip.

In operation, the forward edges 17 and 18 of the guide 9 are brought into contact with the side edge of the decking member 16 thereby referencing the guide to the decking member and the joist underneath.

Figure 7:
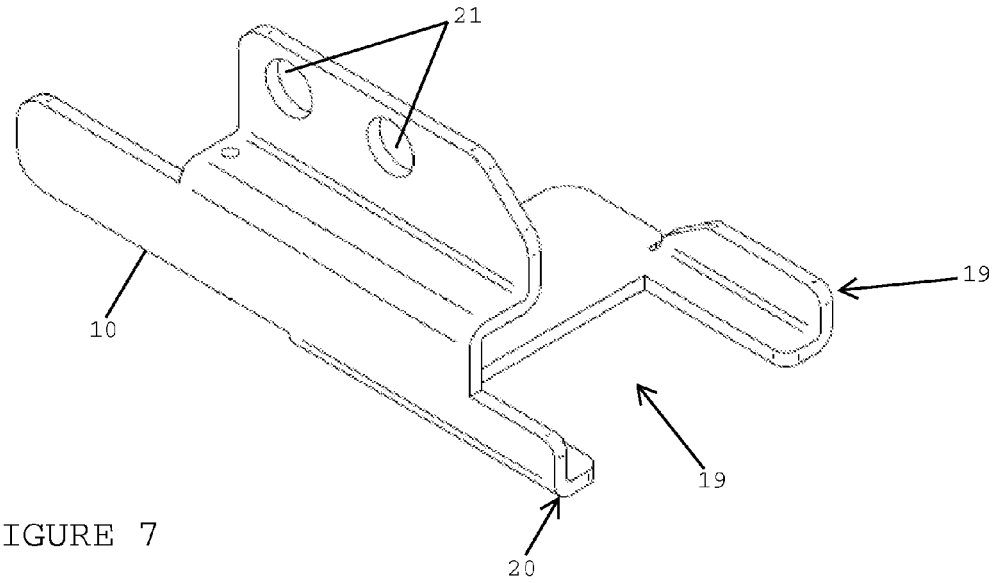
FIG. 7 is a perspective view of the clip installation guide according to one embodiment of this invention
Figure 8:
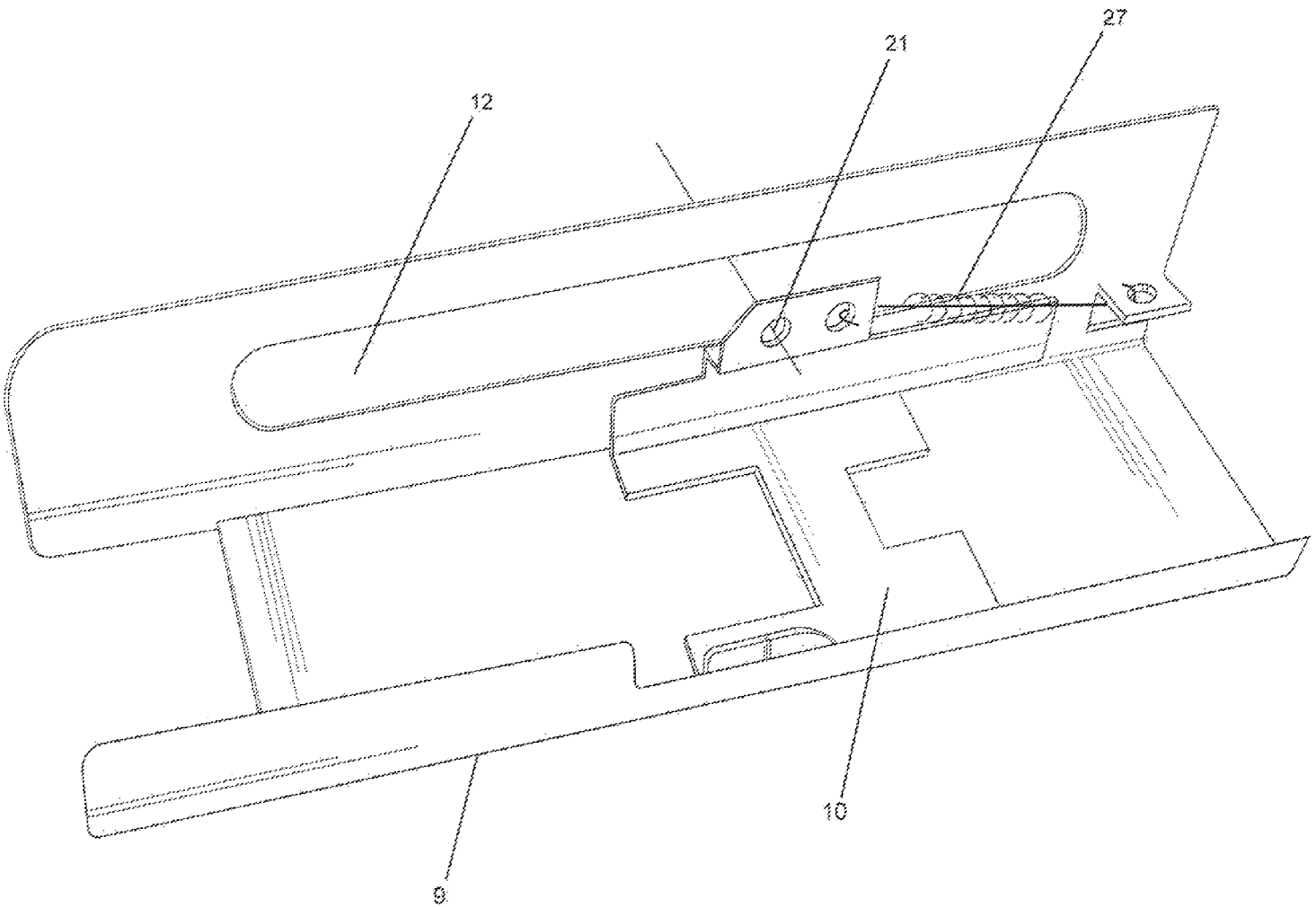
FIG. 8 is a perspective view of a clip guide assembly.
Figure 9:
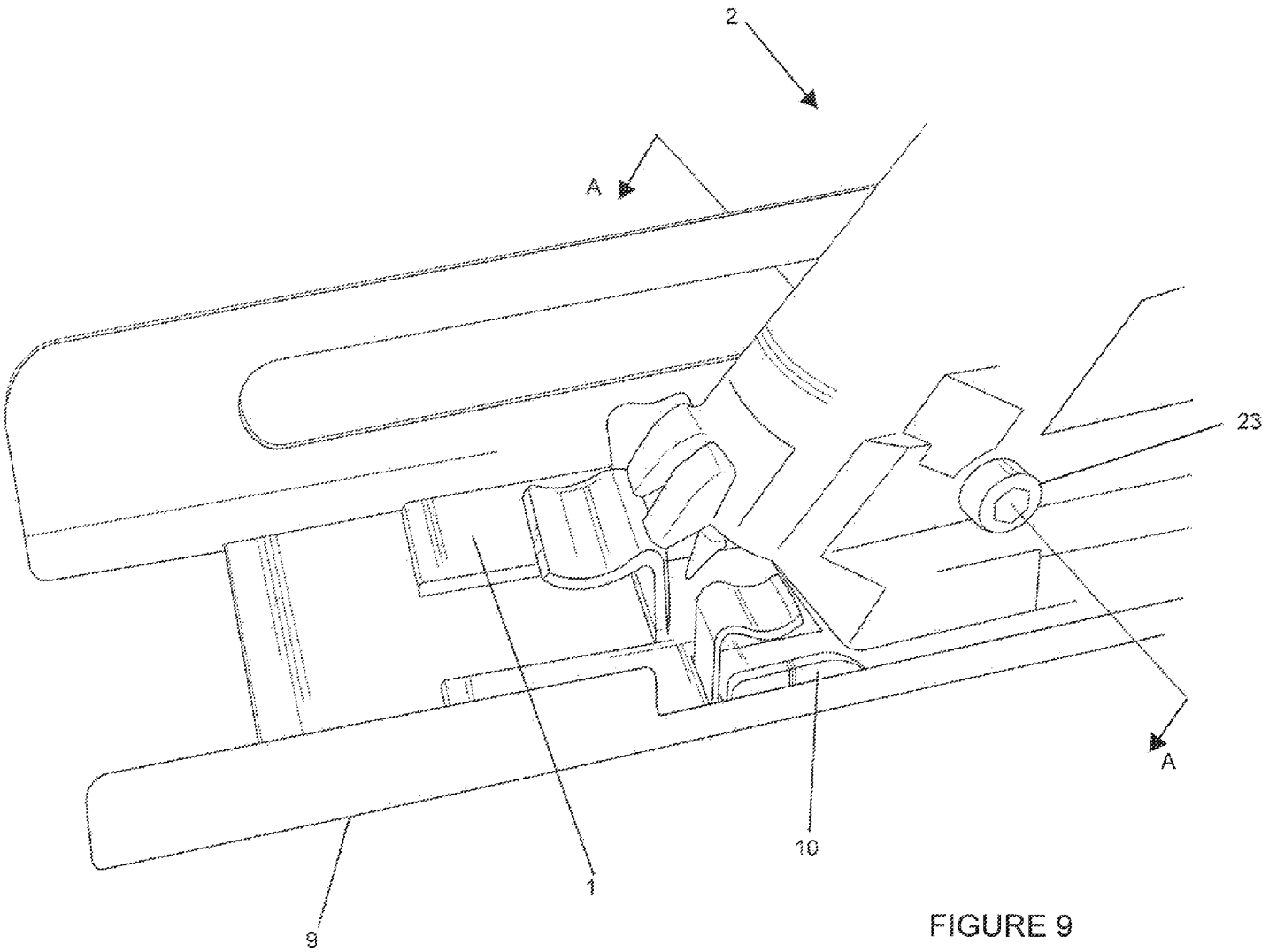
FIG. 9 is a perspective view of the clip guide assembly at FIG. 8 attached to a screw gun holding a clip.

As can be seen in FIG. 7, the clip installation guide has a U-shaped opening 19 having a width and length larger than the width and length of the base portion 3*a* of the clip in order that the base portion 3*a* be received therein. In operation, the leading edges 19 and 20 of the clip installation guide engage the leg members 4 of the clip to thereby urge the clip forward and into position enveloping the bottom edge 8 of the groove. In this position the leg members 4 of the clip are in firm abutting contact against the side edge of the decking member.

When the clip has been placed into the correct installation position described above, the pneumatic screw gun is operated and a screw fastener is inserted into the hole 9 thereby securing the clip and the decking member to the joist. The process is repeated as required along the length of the decking member at each joist or joint interval as required and desired. The next adjacent decking member 6 is manually placed on the joist and urged into position into the exposed opposite side of the installed clips. The installation process then continues with reference to the next decking member.

Further advantages which are inherent to the invention are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

The invention claimed is:

1. A clip guide apparatus for positioning a clip for attachment to an underlying structure by means of a screw gun in the course of attaching a plank to the underlying structure by means of the clip, the clip guide apparatus comprising:

a clip guide assembly comprising sidewalls with front edges for engaging the plank, and a base plate extending between the sidewalls and set back from the front edges to form an open recess for receiving the clip;

wherein one of the sidewalls has a longitudinal attachment slot extending parallel to said base plate for slideable attachment of the clip guide assembly to the screw gun and to permit relative movement between the clip guide assembly and the screw gun;

a clip guide dimensioned to longitudinally slide within the clip guide assembly, the clip guide comprising a base and leading edge for engaging the clip, and an aperture attachment structure for fixed attachment to the screw gun; and a spring operatively connected between the clip guide assembly and the clip guide to maintain the front edges of the clip guide assembly forward of the leading edge of the clip guide to permit manual insertion of the clip.

2. The clip guide apparatus of claim 1 wherein said clip comprises (i) a base portion with first and second opposed ends and a thickness;

(ii) a first vertical leg portion integral with the base portion;

(iii) a second vertical leg portion integral with the base portion wherein said first vertical leg portion is horizontally spaced apart from said second vertical leg portion on said base between said first and second opposed ends;

(iv) arm flange portions integral with the first and second vertical leg portions horizontally spaced from said base and aligned respectively towards said first and second opposed ends; and (v) a fastener receiving means position in the base portion wherein said portions define diametrically opposed first and second U-shaped jaw elements for holding a structural member.

3. The clip guide apparatus of claim 2 wherein the plank is a decking member having a rectangular cross section and a longitudinal groove for receiving one of said arm flange portion of the clip.

4. The clip guide apparatus of claim 3, wherein the leading edge of the clip guide can engage an opposing end of the clip.

5. The clip guide apparatus of claim 1 in combination with the screw gun, wherein the screw gun, the clip guide and clip guide assembly are attached together by a bolt fastener passing through the screw gun to respectively engage the aperture attachment structure of the clip guide for fixed attachment and the longitudinal attachment slot of the clip guide assembly for slideable attachment.

* * * * *